US010899136B2

(12) United States Patent
Butinya et al.

(10) Patent No.: US 10,899,136 B2
(45) Date of Patent: Jan. 26, 2021

(54) PRINTING FLUID RECIRCULATION

(71) Applicant: HEWLETT-PACKARD DEVELOPMENT COMPANY, L.P., Spring, TX (US)

(72) Inventors: David Butinya, Sant Cugat del Valles (ES); Marta Coma Vives, Sant Cugat del Valles (ES); Joan-Albert Miravet, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/335,974

(22) PCT Filed: Jan. 24, 2017

(86) PCT No.: PCT/US2017/014719

§ 371 (c)(1),
(2) Date: Mar. 22, 2019

(87) PCT Pub. No.: WO2018/139986

PCT Pub. Date: Aug. 2, 2018

(65) Prior Publication Data

US 2019/0263130 A1 Aug. 29, 2019

(51) Int. Cl.
*B41J 2/175* (2006.01)
*B41J 2/18* (2006.01)

(52) U.S. Cl.
CPC ..... *B41J 2/17546* (2013.01); *B41J 2/175* (2013.01); *B41J 2/18* (2013.01)

(58) Field of Classification Search
CPC ..... B41J 2/17546; B41J 2/175; B41J 2/18
See application file for complete search history.

(56) References Cited

U.S. PATENT DOCUMENTS 6,033,064 A 3/2000 Pawlowski, Jr. et al.
7,278,718 B2 10/2007 Aruga et al.
(Continued)

FOREIGN PATENT DOCUMENTS

CN 1260750 7/2000
CN 101861246 10/2010
(Continued)

OTHER PUBLICATIONS

"Kyocera Develops One of the World's Fastest 360dpi Recirculating Inkjet Printheads"; Sep. 17, 2015; http://global.kyocera.com/news/2015/0902_jfjs.html.

*Primary Examiner* — Thinh H Nguyen
(74) *Attorney, Agent, or Firm* — HP Inc. Patent Department

(57) ABSTRACT

A printing device comprises a printing fluid supply; a plurality of printheads connected in parallel to the supply by a first flow path and a second flow path; a first fluid pressure source to create a negative fluid pressure between the supply and the first openings; a second fluid pressure source to create a positive fluid pressure between the supply and the second openings; and a controller. Each printhead comprises a closable first opening connected to the first flow path and a closable second opening connected to the second flow path, and has an associated mechanism to increase a fluid pressure in the printhead. Each first opening is to open in response to operation of the associated mechanism. The controller is to identify a first printhead for which printing fluid in the first printhead is to be recirculated; and operate the mechanism associated with the identified printhead.

20 Claims, 6 Drawing Sheets

(56) References Cited

U.S. PATENT DOCUMENTS

| | | | | |
|---|---|---|---|---|
| 8,033,635 | B2 | 10/2011 | Silverbrook et al. | |
| 8,313,179 | B2 * | 11/2012 | Hanson | B41J 2/17596 347/85 |
| 8,814,319 | B2 | 8/2014 | Lebron et al. | |
| 10,391,779 | B2 * | 8/2019 | Katoh | B41J 2/04588 |
| 2008/0055378 | A1 | 3/2008 | Drury et al. | |
| 2011/0164080 | A1 | 7/2011 | Ring | |
| 2013/0169710 | A1 | 7/2013 | Keefe et al. | |
| 2015/0165764 | A1 | 6/2015 | Marler et al. | |

FOREIGN PATENT DOCUMENTS

| | | | |
|---|---|---|---|
| EP | 2772362 | | 9/2014 |
| WO | WO-2012054017 | A1 | 4/2012 |
| WO | WO-2016014085 | | 1/2016 |

* cited by examiner

PRINTING FLUID RECIRCULATION

BACKGROUND

Some printing systems have a reservoir to store printing fluid, such as ink, and a supply system to supply the printing fluid from the reservoir to a printhead, to enable the printhead to apply the printing fluid to a substrate to form an image on the substrate during a print job. The printing fluid may comprise pigment, which lends color to the printed image. The pigment may comprise particles, such as solid and/or opaque particles, that are suspended in the printing fluid.

BRIEF DESCRIPTION OF THE DRAWINGS

Various features of the present disclosure will be apparent from the detailed description which follows, taken in conjunction with the accompanying drawings, which together illustrate, by way of example, features of the present disclosure, and wherein.

DETAILED DESCRIPTION

Figure 1:
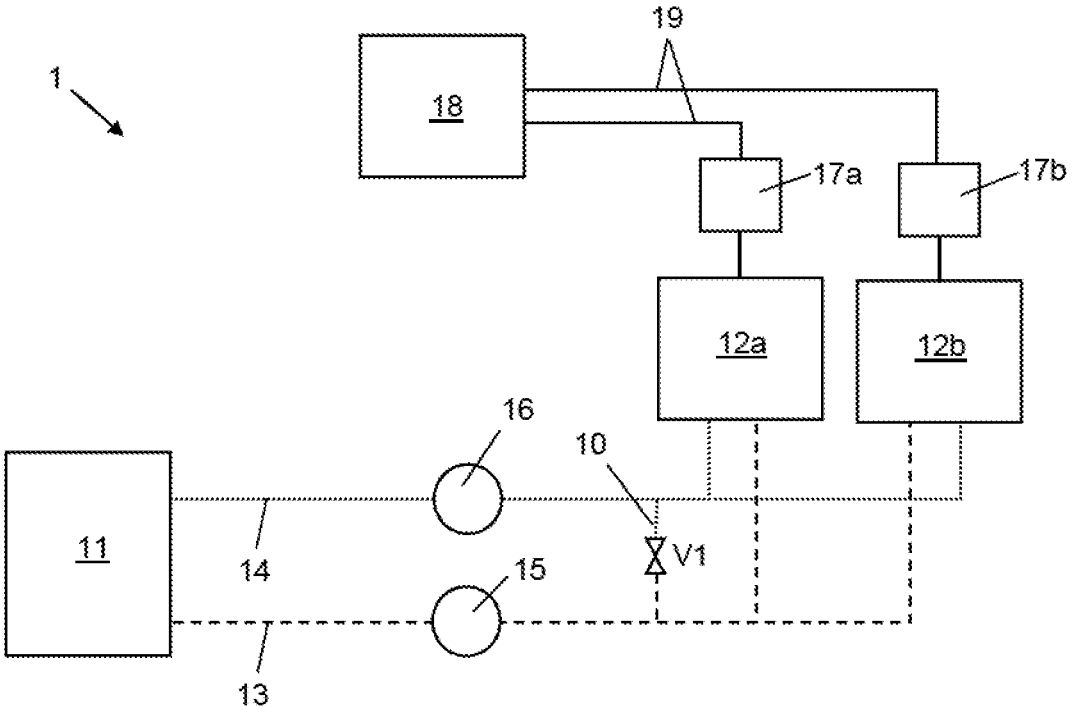
FIG. 1 is a schematic diagram showing an example printing device.

Some inks and other printing fluids comprise pigment or other particles, which can settle and sometimes agglomerate in a flow path or device when the fluid is at rest. Such a flow path or device can comprise, for example, a tube, a pump, a valve, a tank, or a printhead. The path or device may be part of a supply system that is to supply the printing fluid to a printhead during a print job. Over time, such settling or agglomeration can lead to partial or full blocking of the flow path or device. For example, the settled pigment or particles may make the printing fluid more viscous or form a clot. This can result in the flow of the printing fluid during a subsequent print job being hindered or prevented.

Certain examples as described herein provide a printing device, or a method of operating a printing system. Certain examples as described herein enable printing fluid (such as ink) contained in a printhead to be recirculated. The term "recirculated" is used to indicate that the printing fluid is moved from a printhead (or other printing device part downstream of a supply of printing fluid) back to the supply of printing fluid from which it was initially supplied to the printhead. In some examples, this recirculation movement is via a supply system that is to supply the printing fluid to a printhead during a print job. In some examples, the supply system comprises, and the movement is through, tubes and/or pumps and/or valves and/or tanks. This recirculation of the printing fluid can better enable pigment or other particles in the printing fluid to remain suspended in the fluid, such as between print jobs. In some examples, this reduces the risk of the pigment or other particles settling or agglomerating. In some examples, the recirculation of printing fluid is a movement of the printing fluid from one volume to another without the printing fluid moving around a complete circuit. That is, the recirculation can be an end-to-end movement between the two volumes, such as between a printhead and a supply tank.

Certain: examples described herein relate to printing devices or systems having multiple printheads connected in parallel to a supply (source) of printing fluid. A printing device may have multiple printheads connected to the same printing fluid supply (or source), for example, to facilitate multiple print modes. It may be desirable to recirculate printing fluid contained in each of the multiple printheads, for example to avoid or mitigate the settling issues described above. Recirculating the printing fluid in more than one of the multiple printheads simultaneously may create unbalanced flow through the printheads being recirculated. Such unbalanced flow creates a risk of damaging the printheads and other parts of the printing device. Moreover, there is no way to verify that printing fluid in all of the printheads actually has been recirculated (for example, if a regulator valve on one of the printheads is unexpectedly closed during recirculation, printing fluid in that printhead will not be recirculated but the overall flow back to the printing fluid source will not be significantly affected). The examples avoid these risks by enabling printing fluid in an individual printhead of a printing device having multiple printheads connected in parallel to the same source of printing fluid to be recirculated, without simultaneously recirculating printing fluid in the other printheads of the printing device. This is achieved by preventing recirculation in all of the printheads, then enabling recirculation in a selected one of the printheads.

FIG. 1 shows an example printing device 1. The printing device 1 comprises a printing fluid supply 11 and a plurality of printheads 12*a*, 12*b* connected in parallel to the printing fluid supply 11 by a first flow path 13 and a second flow path 14. Each of the printheads 12*a*, 12*b* comprises a closable first opening connected to the first flow path and a closable second opening connected to the second flow path. Each of the printheads 12*a*, 12*b* has an associated pressure control mechanism 17*a*, 17*b* operable to increase a fluid pressure in the printhead. The first opening of each printhead 12*a*, 12*b* is to open in response to the operation of the pressure control mechanism 17*a*, 17*b* associated with the printhead. The printing device 1 further comprises a first fluid pressure source 15 to create a negative fluid pressure between the printing fluid supply 11 and the first openings; and a second fluid pressure source 16 to create a positive fluid pressure between the printing fluid supply 11 and the second openings. The printing device 1 further comprises a controller 18 to identify one 12*a* of the printheads for which printing fluid in the printhead 12*a* is to be recirculated to the printing fluid supply 11; and to operate the pressure control mechanism 17*a* associated with the identified printhead 12*a* to open the first opening of the identified printhead 12*a*.

The printing fluid supply 11 may take any form suitable to store printing fluid. For example, the printing fluid supply 11 may be a tank or other receptacle. The printing fluid supply 11 may be a closed reservoir or may be open to the atmosphere.

The first flow path 13 (shown by dashed lines in FIG. 1) extends from the printing fluid supply 11 to each of the plurality of printheads 12*a*, 12*b*. The first flow path 13 fluidly connects the printing fluid supply 11 to each of the plurality of printheads 12*a*, 12*b*. The end of the first flow path 13 nearest to the plurality of printheads comprises multiple branches (one for each printhead, in this example) such that it may connect to each printhead of the plurality of printheads. Each of the branches of the first flow path 13 connects to a different printhead of the plurality of printheads. Each of the branches connects to a first opening of a printhead.

The second flow path 14 (shown by dotted lines in FIG. 1) extends from the printing fluid supply 11 to each of the plurality of printheads 12*a*, 12*b*. The second flow path 14 fluidly connects the printing fluid supply 11 to each of the plurality of printheads 12*a*, 12*b*. The end of the first flow path 14 nearest to the plurality of printheads comprises multiple branches (one for each printhead, in this example) such that it may connect to each printhead of the plurality of printheads. Each of the branches of the first flow path 14 connects to a different printhead of the plurality of printheads. Each of the branches connects to a second opening of a printhead.

Each of the first and second flow paths 13, 14 may take any suitable form to move printing fluid from one location to another. For example, the first and second flow paths 13, 14 may comprise any combination of tubes; conduits; valves; connectors; pumps; or the like. In some examples the first and second flow paths 13, 14 are connected by a bypass path 10. The bypass path 10 fluidly connects a point on the first flow path 13 between the printing fluid supply 11 and the first openings to a point on the second flow path 14 between the printing fluid supply 11 and the second openings. The bypass path 10 comprises an electrovalve V1 which is communicatively coupled to and controllable by the controller 18. The electrovalve V1 is normally closed, but may be opened to enable a positive fluid pressure to be simultaneously applied to both the first openings and the second openings, as will be described in more detail later. The first flow path 13 and the second flow path 14 together with the printing fluid supply 11 may form or otherwise be comprised in a printing fluid supply system to supply printing fluid from the printing fluid supply 11 to the printheads 12*a*, 12*b*.

Each printhead 12*a*, 12*b* has a plurality of nozzles to apply printing fluid to a substrate, such as paper. Each printhead may further comprise a regulator mechanism, for regulating the flow of printing fluid into the printhead. The printheads 12*a*, 12*b* may be identical or substantially identical. The printheads 12*a*, 12*b* are described in more detail below with reference to FIG. 5.

Each pressure control mechanism 17*a*, 17*b* is communicatively linked to the controller 18 by a communications link 19, which may be wired or wireless. The pressure control mechanisms may thereby be selectively activated by the controller 18. The pressure control mechanisms 17*a*, 17*b* are described in more detail below with reference to FIG. 5.

The first fluid pressure source 15 is to create a negative fluid pressure between the printing fluid supply and the first openings. The first fluid pressure source 15 may be a selectively activatable fluid pressure source, e.g. activatable by the controller 18. The first fluid pressure source 15 may comprise a pump. The first fluid pressure source 15 may comprise an air pump. In some examples the first fluid pressure source may not be selectively activatable. In some such examples the first fluid pressure source may be a gravitational fluid pressure source, wherein the negative fluid pressure is created by a height difference between the printing fluid supply 11 and the first openings.

The second fluid pressure source 16 is to create a positive fluid pressure between the printing fluid supply and the second openings. The second fluid pressure source 16 may be a selectively activatable fluid pressure source, e.g. activatable by the controller 18. The second fluid pressure source 16 may comprise a pump. The second fluid pressure source 16 may comprise an air pump.

Figure 2:
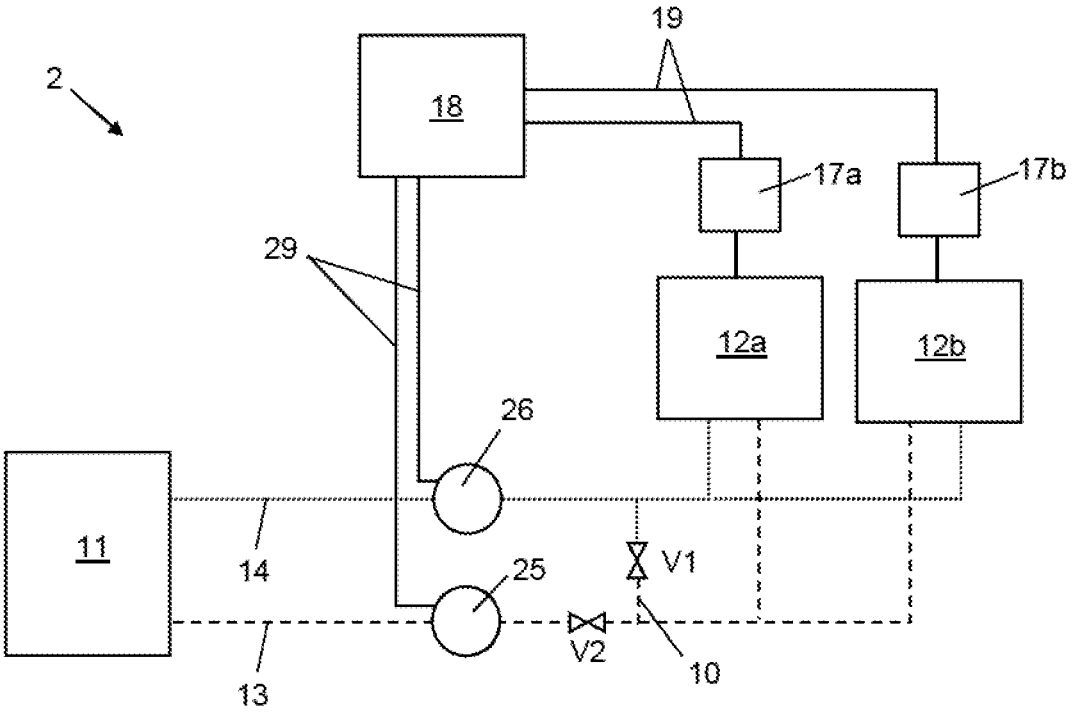
FIG. 2 is a schematic diagram showing a further example printing device.

FIG. 2 shows an example printing device 2 in which a first fluid pressure source 25 and a second fluid pressure source 26 each comprise selectively activatable fluid pressure sources. The example printing device 2 comprises a printing fluid supply 11, printheads 12*a*, 12*b*, pressure control mechanisms 17*a*, 17*b*, first and second fluid paths 13, 14, bypass path 10, communications links 19, and a controller 18, which may be the same as the corresponding components of the example printing device 1 described above. Each of the first and second fluid pressure sources 25, 26 is communicatively connected to the controller 18 by a communications link 29, which may be wired or wireless. The pressure control mechanisms may thereby be selectively activated by the controller 18.

The first fluid pressure source 25 is fluidly connected between the printing fluid supply 11 and the first openings, to pump printing fluid towards the printing fluid supply 11 through the first flow path 13. In some examples the first fluid pressure source may also be able to operate in reverse, to pump printing fluid from the printing fluid supply 11 towards the first openings. Any suitable type of fluid pump may be used as the first fluid pressure source 25. In the particular example the first fluid pressure source 25 comprises a suction pump. When the suction pump is activated it operates to create a fluid flow from the printheads 12*a*, 12*b* towards the printing fluid supply 11. In some examples an electrovalve V2 is provided in the first flow path 13, between the first fluid pressure source 25 and the point of connection to the bypass path 10. The electrovalve V2 is communicatively coupled to and controllable by the controller 18. The electrovalve V2 may be normally open, but may be closed to prevent a negative fluid pressure being applied to the first openings. Preventing a negative fluid pressure from being applied to the first openings may facilitate creating a positive fluid pressure between the printing fluid supply 11 and the first openings when the electrovalve V1 is open.

Figure 3:
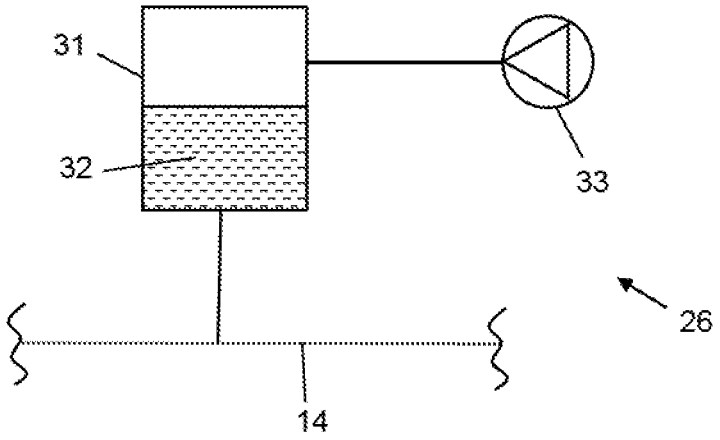
FIG. 3 is a schematic diagram showing an example fluid pressure source for the example printing device of FIG. 2.

The second fluid pressure source 26 is shown in more detail in FIG. 3. The second fluid pressure source 26 comprises an air-tight container 31 for containing printing fluid. In FIG. 3 the container 31 is shown partially filled with printing fluid. The container 31 is in fluid communication with the second flow path 14. In some examples the container 31 may be selectively connectable to the second flow path 14 by a valve (not shown). The second fluid pressure source 26 further comprises an air pressure system 33 to supply pressurized air into the container. In the particular example the air pressure system 33 comprises an air pump. The air pressure system 33 may be selectively connectable to the container 31, e.g. by a valve (not shown). In some examples the air pressure system 33 may have a direct connection to the second flow path 14, in addition to having a connection to the container 31. The direct connection to the second flow path 14 may be normally closed. The direct connection may comprise a selectively activatable valve, such as an electrovalve.

The air pressure system 33 is communicatively coupled to the controller 18 by the communications link 29, and the controller 18 is to activate the second fluid pressure source 26 by operating the air pressure system 33 to supply pressurized air into the container 31 to create a selected level of positive fluid pressure in the second flow path 14. The container 31 and/or the second flow path 14 may comprise a fluid pressure sensor communicatively coupled to the controller 18. The controller 18 may be to control the operation of the second fluid pressure source 26 based on measurement data received from the fluid pressure sensor.

Figure 4:
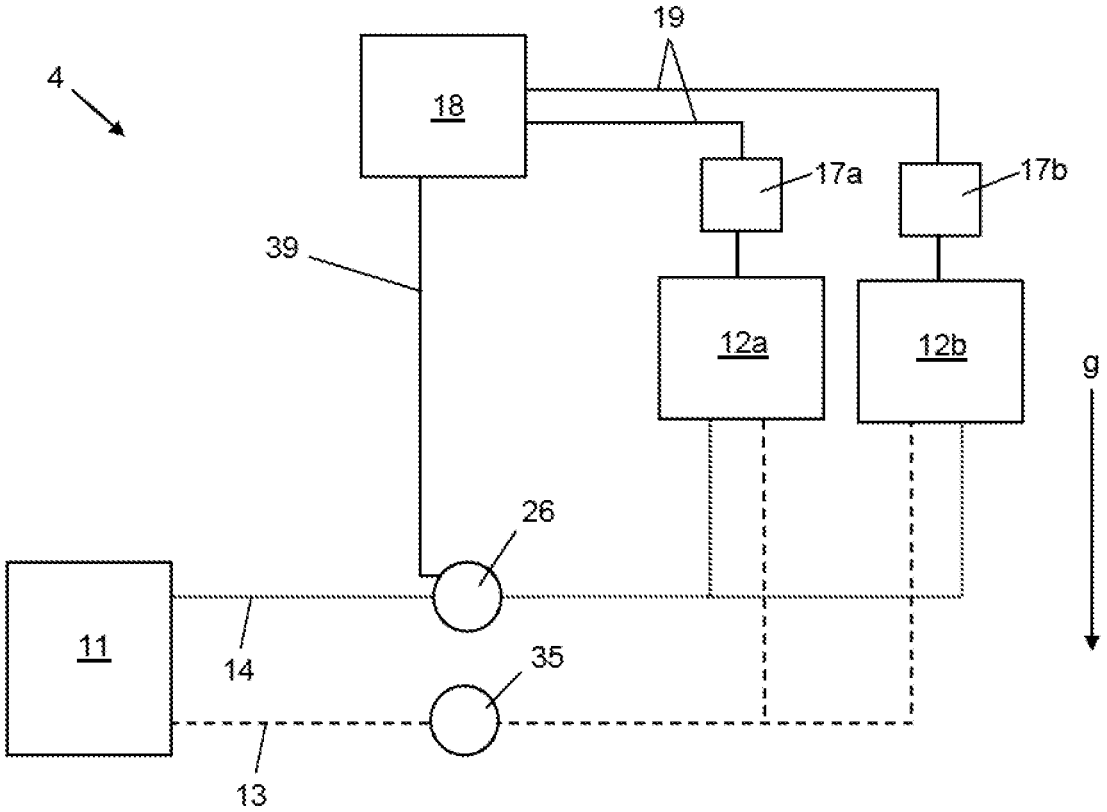
FIG. 4 is a schematic diagram showing a further example printing device.

FIG. 4 shows an example printing device 4 in which a first fluid pressure source 25 comprises a gravitational fluid pressure source. The example printing device 4 comprises a printing fluid supply 11, printheads 12*a*, 12*b*, pressure control mechanisms 17*a*, 17*b*, first and second fluid paths 13, 14, communications links 19, and a controller 18, which may be the same as the corresponding components of the example printing device 1 described above, and a selectively activatable second fluid pressure source 26, which may be the same as the corresponding component of the example printing device 2 described above. The gravitational fluid pressure source 35 comprises a relative arrangement of the printing fluid supply 11 and the first openings of the printheads 12*a*, 12*b* in which the first openings are higher than the printing fluid supply 11 in an in use-orientation of the printing device 4, with respect to a gravitational field in which the printing device 4 is disposed (in the illustrated example the gravitational field is the Earth's gravitational field g). A negative fluid pressure between the printing fluid supply 11 and the first openings is thereby created by the action of the gravitational field g on printing fluid in the printing device 4.

Figure 5:
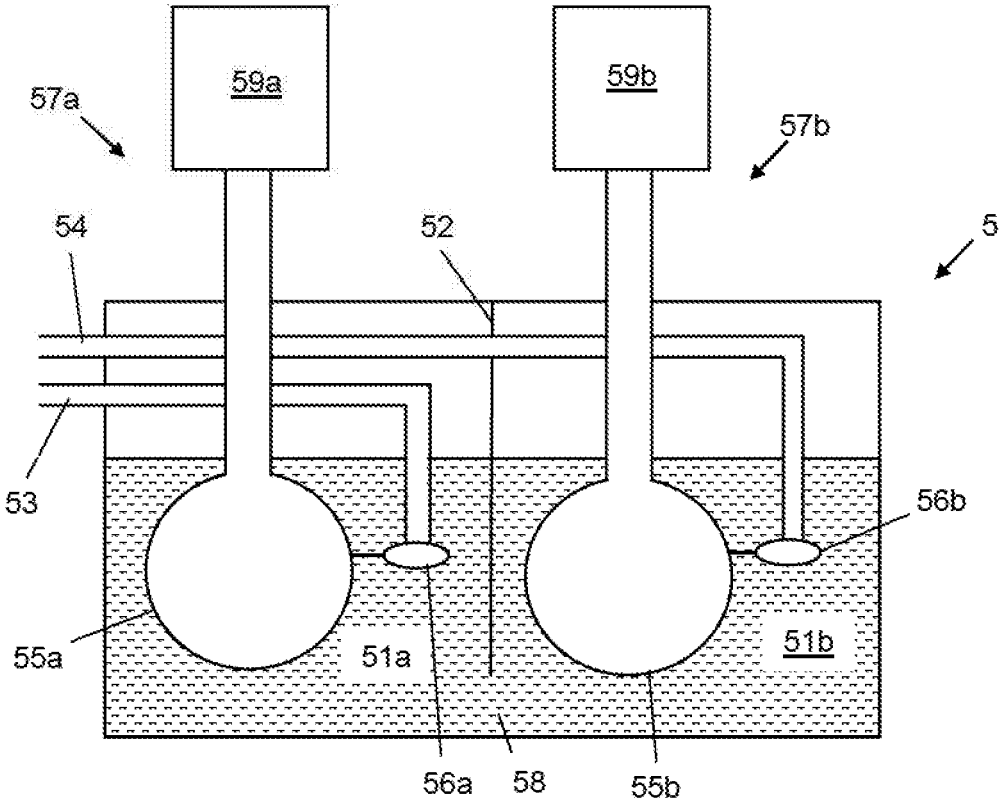
FIG. 5 is a schematic diagram showing an example printhead.

FIG. 5 shows an example printhead 5 of a printing device having multiple printheads connected in parallel to a printing fluid supply. The printhead 5 may be, for example, the printhead 12*a* or the printhead 12*b* of any of the example printing devices described above. The printhead 5 may be an inkjet printhead. The printhead 5 may comprise various features such as filters, nozzles, and the like which are used during a printing operation but are not involved in the recirculation of printing fluid in the printhead. Such features are therefore not described below or shown on FIG. 5.

The printhead 5 comprises a first chamber 51*a* and a second chamber. The first chamber 51*a* is separated from the second chamber 51*b* by a partition 52. The partition 52 does not completely separate the first and second chambers 51*a*, 51*b*, such that the first and second chambers 51*a*, 51*b* are in fluid communication via a gap 58. In the particular example the first and second chambers 51*a*, 51*b* are substantially identical in size and configuration.

The first opening of the printhead 5 opens into the first chamber 51*a*. The second opening of the printhead 5 opens into the second chamber 51*b*. In the illustrated example, the first opening comprises an open end of a first tube 53 which extends into the first chamber 51*a*. In other examples, the first tube 53 may not extend into the first chamber 51*a*, in which case the first opening may comprise an opening in a wall of the first chamber 51*a*. The first tube 53 forms part of the first flow path 13. In the illustrated example, the second opening similarly comprises an open end of a second tube 54 which extends into the second chamber 51*b*. In other examples, the second tube 54 may not extend into the second chamber 51*b*, in which case the second opening may comprise an opening in a wall of the second chamber 51*b*. The second tube 54 forms part of the second flow path 14.

In the particular example the first and second openings and their associated closure mechanisms are substantially identical (although this may not be the case in every example). Therefore the first opening will be described in detail and the second opening will not be described. Features of the first opening and its associated closure mechanisms may be assumed to be replicated in respect of the second opening. Features of the first and second openings which are substantially identical are labelled with the same reference number on FIG. 6, with the suffix "a" indicating features of the first opening (and associated mechanisms) and the suffix "b) indicating features of the second opening (and associated mechanisms).

The first opening comprises a valve 56*a* to selectively close that first opening and thereby block a flow path between the printhead 5 and the printing fluid supply 11. In the particular example, the first opening comprises a needle, which is closable by a printhead regulator valve. A printhead regulator valve is to selectively allow printing fluid into the printhead during a printing operation of the printing device. A printhead regulator valve may open automatically when a level of printing fluid in the printhead drops below a predefined threshold. Actuation of such a regulator valve may be actuated mechanically, e.g. by exploiting a physical effect of the change in printing fluid level. The valve 56*a* is an example of such a mechanically actuated regulator valve, as will be explained in more detail below.

A pressure control mechanism 57*a* associated with the printhead 5 is connected to the valve 56*a*. The pressure control mechanism 57*a* is operable to increase a fluid pressure in the printhead. In the particular example, the pressure control mechanism 57*a* is operable to increase the fluid pressure in the first chamber 51*a*, for example as part of a priming process for the printhead.

The example pressure control mechanism 57*a* comprises an expandable component 55*a*, which is disposed within the first chamber 51*a*. The example pressure control mechanism 57*a* also comprises a selectively activatable mechanism 59*a* to cause expansion of the expandable component. In the particular example, the expandable component 55*a* comprises a regulator bag. During normal printing, the interior of the regulator bag is open to atmosphere, such that it expands as the amount of printing fluid in the first chamber 51*a* reduces. The regulator bag is connected to the valve 56*a* such that expansion of the bag causes the valve 56*a* to open. In a particular example, the regulator bag 55*a* is in contact with a lever, such that inflation of the bag causes movement of the lever. A valve seat of the valve 56*a* is provided on the lever. The lever and valve seat are configured such that when the regulator bag 55*a* is not inflated the valve seat blocks a valve opening of the valve 56*a*, and when the regulator bag 55*a* is not inflated, the valve seat does not block a valve opening of the valve 56*a*. When the regulator bag 55*a* is partially inflated the lever may be in an intermediate position in which the valve seat partially blocks the valve opening. In some examples the valve may be to control the size of the first opening, in which case the connection between the valve 56*a* and the regulator bag may be such that the size of the first opening is controlled in dependence on the degree of inflation of the regulator bag.

The selectively activatable mechanism 59*a* enables the regulator bag 55*a* to be inflated regardless of the printing fluid level in the first chamber 51*a*. Such inflation may be advantageous, for example, to increase the fluid pressure in the first chamber 51*a* in order to force printing fluid out through nozzles of the printhead 5, to remove air or debris from those nozzles. This cleaning process is known as blow priming. In the particular example, the selectively activatable mechanism 59*a* comprises a blow priming pump. The blow priming pump is selectively connectable to the interior of the regulator bag 55*a* (e.g. by an electrovalve). When the blow priming pump 59*a* is connected to the regulator bag 55*a*, the interior of the regulator bag is not open to atmosphere. When the blow priming pump 59*a* is connected to the regulator bag 55*a*, activation of the blow priming pump (e.g. by the controller 18) causes inflation of the regulator bag 55*a*. By virtue of the connection between the regulator bag 55*a* and the valve 56*a*, activation of the blow priming pump 59*a* causes the valve 56*a* to open.

Returning to FIG. 1, the controller 18 of the printing device 1 may, for example, be an integrated circuit or a microprocessor. As mentioned above, the controller 18 is to identify one of the printheads 12*a*, 12*b* for which printing fluid in the printhead is to be recirculated to the printing fluid supply 11. The controller 18 may perform this identification automatically, e.g. based on predefined rules stored in a memory accessible by the controller 18. In some examples the controller 18 may perform the identification based on an input (e.g. a command) received from a user of the printing device, indicating that a particular one of the printheads 12*a*, 12*b* is to be recirculated.

The controller 18 is further to operate the pressure control mechanism 17*a* associated with the identified printhead 12*a* to open the first opening of the identified printhead 12*a*. The controller 18 may be to operate the pressure control mechanism by sending an activation signal to the pressure control mechanism 17*a* of the identified printhead 12*a*. In some examples the controller 18 may be to send such an activation signal to a selectively activatable component of a pressure control mechanism, such as a blow priming pump. The controller 18 may be to operate the associated pressure control mechanism 17*a* (that is, the pressure control mechanism associated with the identified printhead 12*a*) such that it is activated for a predetermined period of time. The controller 18 may be to deactivate the associated pressure control mechanism 17*a* after the predetermined period of time has elapsed. In examples in which the associated pressure control mechanism 17*a* comprises a regulator bag, the predetermined period of time may be determined to be sufficient for an inflation mechanism of the associated pressure control mechanism 17*a* to inflate the regulator bag by a predetermined amount.

In examples in which the at least one of the first and second fluid pressure sources 15, 16 is a selectively activatable fluid pressure source 25, 26, the controller 18 may be to activate the at least one selectively activatable fluid pressure source 25, 26 by sending an activation signal to the at least one selectively activatable fluid pressure source. In some examples, the controller 18 may be to activate the at least one selectively activatable fluid pressure source 25, 26 at a first time, and to operate the associated pressure control mechanism 17*a* at a second time, wherein the second time is later than the first time by at least a predefined delay value. Such a predefined delay value may be stored in a memory accessible by the controller 18. The predefined delay value may be in the range 0.2 seconds to 10 seconds. The predefined delay value may be in the range 0.25 seconds to 2 seconds. The use of such a delay may ensure that all of the printhead openings are in desired state (e.g. a closed state), before the first opening of the identified printhead 12*a* is opened. This can ensure that recirculation is enabled for the identified printhead 12*a* and not for any other printheads of the printing device 1.

The controller 18 may be to stop recirculation of printing fluid in the identified printhead 12*a*. In some examples the controller 18 is to stop recirculation by deactivating the at least one selectively activatable fluid pressure source 25, 26, e.g. by transmitting a suitable deactivation signal or signals. In examples in which the first fluid pressure source 15 comprises a selectively activatable first fluid pressure source 25 and the second fluid pressure source 16 comprises a selectively activatable second fluid pressure source 26, the controller may deactivate both of the first fluid pressure source 25 and the second fluid pressure source 26 to stop recirculation in the identified printhead 12*a*, or may deactivate the second fluid pressure source 26 and may not deactivate the first fluid pressure source. It will be appreciated that in examples in which the first fluid pressure source 15 is a gravitational fluid pressure source 35 (such as the example of FIG. 4) it is not possible to deactivate the first fluid pressure source 35. In some examples in which the first fluid pressure source 15 is a gravitational fluid pressure source 35, the may be to not deactivate either of the first and second fluid pressure sources. In some examples, the controller 18 may be to stop recirculation of printing fluid in the identified printhead 12*a* by maintaining the second fluid pressure source 16 in an activated state.

It may be advantageous, in certain situations, to recirculate two or more printheads 12*a*, 12*b* of a printing device consecutively. Therefore, in some examples the controller 18 is to change the printhead being recirculated from the identified printhead 12*a* to a different printhead. The controller 18 may, for example, be to change the printhead being recirculated by identifying a further one 12*b* of the printheads 12*a*, 12*b* for which printing fluid in the printhead is to be recirculated to the printing fluid supply 11 (e.g. in any of the manners described above in relation to identifying of the (original) identified printhead 12*a* by the controller 18). The controller may be to change the printhead being recirculated by deactivating at least one selectively activatable fluid pressure source 25, 26. The controller 18 may be to change the printhead being recirculated by operating the pressure control mechanism 17*b* associated with the identified further printhead 12*b* to open the first opening of the identified further printhead 12*b*.

To ensure that recirculation in the identified printhead 12*a* does not occur simultaneously with recirculation in the identified further printhead 12*b*, the controller 18 may be to close the first opening of the identified printhead 12*a*. As discussed above, in certain examples each first opening of the printheads 12*a*, 12*b* is to open and close in dependence on a degree of inflation of a regulator bag 55*a*, 55*b* (such that each first opening is open when its associated regulator bag is inflated and closed when that regulator bag is deflated). A regulator bag 55*a*, 55*b* in a printhead 12*a*, 12*b* can be deflated by increasing the fluid pressure in that printhead. Therefore, in some examples the controller 18 is to close the first opening of the identified printhead 12*a* by increasing the fluid pressure in at least the identified printhead 12*a*.

An example way in which the controller 18 can increase the fluid pressure in the identified printhead 12*a* is to create a positive fluid pressure between the printing fluid supply 11 and the first openings and between the printing fluid supply 11 and the second openings. In examples in which the printing device 1 comprises a bypass path 10, the second fluid pressure source 16 is selectively connectable to the first openings by opening the electrovalve V1. In such examples the controller 18 may be to connect the second fluid pressure source 16 to the first openings by opening the electrovalve V1 to create a flow path between the second fluid pressure source 16 and the first openings. Thus, in some examples the controller 18 is to change the printhead 12*a*, 12*b* being recirculated by operating a valve to create a flow path between the second fluid pressure source 16 and the first openings (such that a flow path exists between the second fluid pressure source and the first openings and a flow path exists between the second fluid pressure source and the second openings).

In examples in which the first fluid pressure source 15 comprises an active component such as a pump, the controller 18 may be to block a flow path between the first fluid pressure source 15 and the printheads 12*a*, 12*b* in order to increase the fluid pressure in the identified printhead 12*a*. In such examples the controller 18 may be to block a flow path between the first fluid pressure source 15 and the printheads 12*a*, 12*b* by closing an electrovalve disposed between the first fluid pressure source 15 and the printheads 12*a*, 12*b*. The printing device 2 comprises one such example, and in this example the controller may be to block a flow path between the first fluid pressure source 15 and the printheads 12*a*, 12*b* by closing the electrovalve V2.

The controller 18 may be to operate a valve to create a flow path between the second fluid pressure source 16 and the first openings such that the flow path between the second fluid pressure source 16 and the first openings exists for a predefined time period. The controller 18 may be to operate a valve to block a flow path between the second fluid pressure source 16 and the first openings after the predefined time period has elapsed. The predefined time period may be defined to be sufficiently long for the first opening of the identified printhead 12*a* to close under the influence of the positive fluid pressure created in the identified printhead 12*a* by the creation of the flow path between the second fluid pressure source 16 and the first opening of the identified printhead 12*a*. It may be assumed that the first opening of the identified printhead 12*a* is open immediately prior to the creation of a flow path between the second fluid pressure source 16 and the first openings, if recirculation of printing fluid in the identified printhead 12*a* was occurring at that time. The duration of the predefined time period may be in the range 5-20 s.

In some examples, the controller 18 is to change the printhead 12*a*, 12*b* being recirculated by operating the pressure control mechanism 17*b* associated with the identified further printhead 12*b* to open the first opening of the identified further printhead 12*b*. Operating the pressure control mechanism 17*b* associated with the identified further printhead may be performed by the controller 18 in the same manner as operating the pressure control mechanism 17*a* associated with the (original) identified printhead 12*a*. The controller 18 may be to operate the pressure control mechanism 17*b* associated with the identified further printhead 12*b* responsive to the predefined time period having elapsed. In examples in which at least one of the first and second fluid pressure sources 15, 16 is a selectively activatable fluid pressure source 25, 26, the controller 18 may activate the at least one selectively activatable fluid pressure source 25, 26 before operating the pressure control mechanism 17*b* associated with the identified further printhead 12*b*. As discussed above, operating the pressure control mechanism 17*b* causes the first opening of the identified further printhead 12*b* to open, which enables printing fluid in the identified further printhead 12*b* to be recirculated (that is, to flow back to the printing fluid supply 11 along the first flow path 14) under the influence of the negative pressure created by the first fluid pressure source 15.

Figure 6:
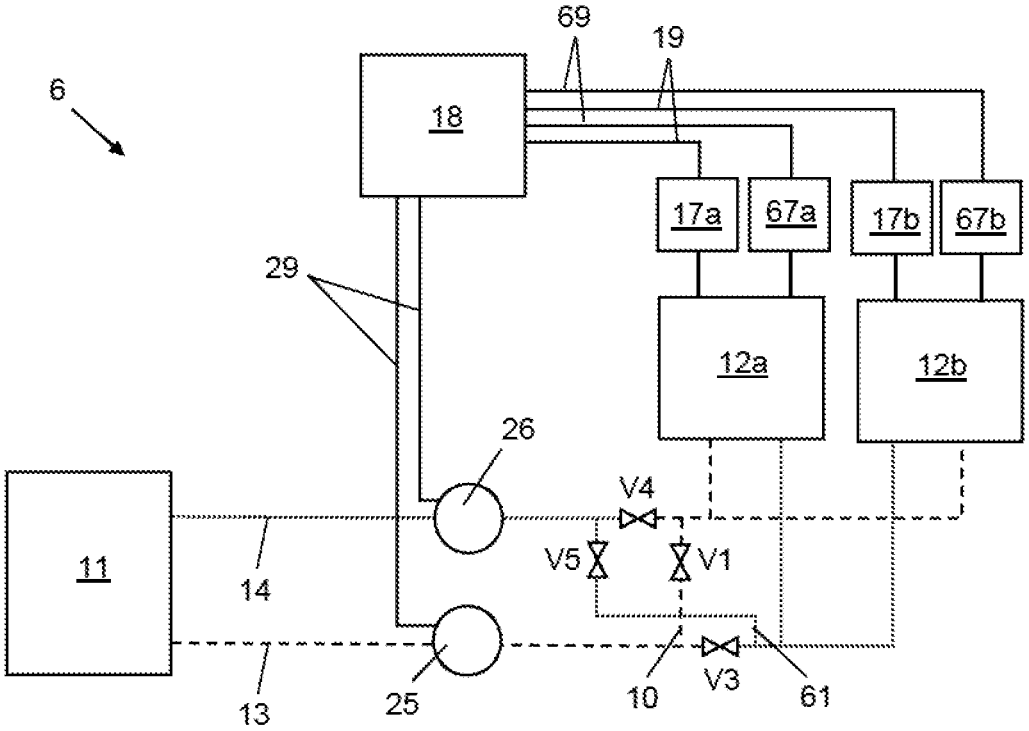
FIG. 6 is a schematic diagram showing a further example printing device.

In some examples, a printing device having multiple printheads connected in parallel to a printing fluid supply may be to recirculate printing fluid in an identified (selected) printhead along a selected one of a first flow path which connects the printing fluid supply to first openings of the printheads, and a second flow path which connects the printing fluid supply to second openings of the printheads. FIG. 6 shows such an example printing device.

The example printing device 6 of FIG. 6 comprises a printing fluid supply 11, printheads 12*a*, 12*b*, selectively activatable first and second fluid pressure sources 25, 26, pressure control mechanisms 17*a*, 17*b*, first and second fluid paths 13, 14, a bypass path 10, communications links 19, and a controller 18, which may be the same as the corresponding components of the example printing devices 1 and 2 described above. The printing device 6 further comprises a second bypass path 61, further electrovalves V3, V4 and V5, and further pressure control mechanisms 67*a*, 67*b*.

The further bypass path 61 fluidly connects a point on the first flow path 13 between the connection to the bypass path 10 and the first openings to a point on the second flow path 14 between the printing fluid supply 11 and the connection to the bypass path 10. Thus, the further bypass path 61 connects to the first flow path 13 further from the printing fluid supply 11 than the bypass path 10, and connects to the second flow path 14 closer to the printing fluid supply 11 than the bypass path 10. The further bypass path 61 comprises the electrovalve V5, which is communicatively coupled to and controllable by the controller 18. The electrovalve V5 is normally closed, but may be opened to enable a reverse recirculation mode of the printing device 6, as will be described in more detail later.

The electrovalve V3 is disposed in the first flow path 13, between: the connection: point to the bypass path 10 and the connection point to the further bypass path 61. The electrovalve V3 is communicatively coupled to and controllable by the controller 18. The electrovalve V3 is normally open, but may be closed to reroute the first flow path 13 and thereby enable the reverse circulation mode. The electrovalve V4 is disposed in the second flow path 14, between the connection point to the bypass path 10 and the connection point to the further bypass path 61. The electrovalve V4 is communicatively coupled to and controllable by the controller 18. The electrovalve V4 is normally open, but may be closed to reroute the second flow path 14 and thereby enable the reverse circulation mode.

The controller 18 may be to recirculate one 12*a* of the printheads 12*a*, 12*b* according to a forward recirculation mode, or according to a reverse circulation mode. The controller 18 may be to recirculate the printhead 12*a* according to the forward recirculation mode by closing the electrovalves V1 and V5, and opening the electrovalves V3 and V4. Other operations performed by the controller to recirculate the printhead 12*a* may be the same as those described above in relation to the example printing devices 1 and 2.

The controller 18 may be to recirculate the printhead 12*a* according to the reverse recirculation mode by closing the electrovalves V3 and V4, and opening the electrovalves V5 and V1 (hereinafter referred to as the reverse valve configuration). As can be seen from FIG. 6, operating the valves in this manner reroutes the first flow path 13 such that it connects the first fluid pressure source 25 to the second openings of the printheads 12*a*, 12*b*, and reroutes the second flow path 14 such that it connects the second fluid pressure source 26 to the first openings of the printheads 12*a*, 12*b*.

The controller 18 may be to recirculate the printhead 12*a* according to the reverse recirculation mode by activating the first fluid pressure source 25 and the second fluid pressure source 26, for example in the manner described above in relation to the example printing device 2. Activation of the first and second fluid pressure sources 25, 26 with the electrovalves in the reverse valve configuration causes a positive fluid pressure to be applied to the first openings of the printheads 12*a*, 12*b* and a negative fluid pressure to be applied to the second openings of the printheads 12*a*, 12*b*.

Each of the further pressure control mechanisms 67*a*, 67*b* is associated with a respective one of the printheads 12*a*, 12*b*. Each further pressure control mechanism 67*a*, 67*b* operable to increase a fluid pressure in the associated printhead. The second opening of each printhead 12*a*, 12*b* is to open in response to the operation of the further pressure control mechanism 67*a*, 67*b* associated with the printhead. The controller 18 may be to recirculate the printhead 12*a* according to the reverse circulation mode by operating the further pressure control mechanism 67*a* associated with the printhead 12*a*, to open the second opening of the printhead 12*a*. The controller 18 may be to operate the further pressure control mechanism 67*a* in the same manner described above in relation to the pressure control mechanisms 17*a*, 17*b* of the example printing devices 1, 2 and 4.

Thus, recirculating a printhead 12*a*, 12*b* according to the reverse recirculation mode results in printing fluid flowing out through the second opening of the printhead, rather than out through the first opening of the printhead as is the case when the printhead is recirculated according to the forward recirculation mode. In some examples the controller 18 may be to recirculate a given printhead 12*a*, 12*b* according to one of the forward and reverse recirculation modes, and subsequently according to the other one of the forward and reverse recirculation modes.

Figure 7:
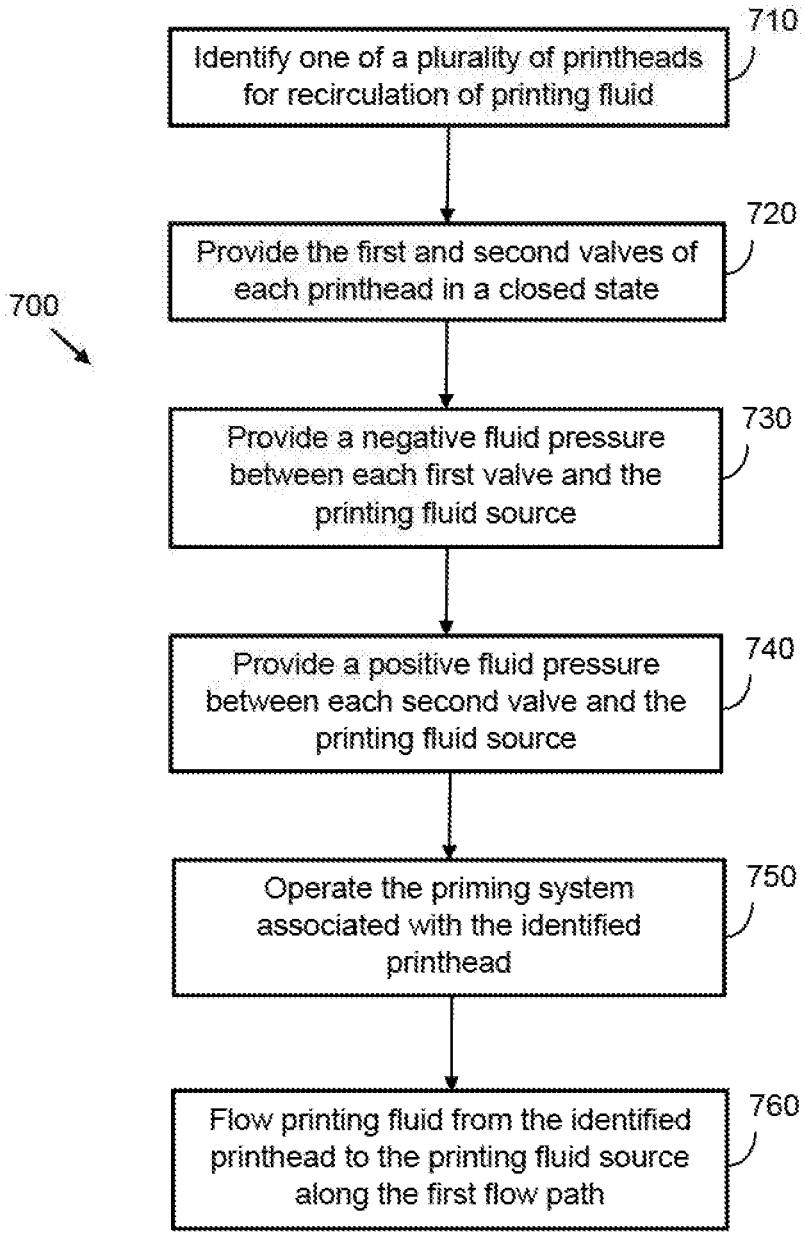
FIG. 7 is a flow diagram showing an example method of operating a printing system.

An example method 700 of operating a printing system (which may comprise any of the example printing devices 1, 2, 4, 6 described above) will now be described with reference to FIG. 7, which shows a flow chart implementing the example method 700. The printing system operated by the example method 700 comprises a printing fluid source; a plurality of printheads (which may each have any of the features of the example printheads 12*a*, 12*b* and 5 described above) each connected to the printing fluid source by a first flow path and a second flow path, and each comprising a first valve to selectively block the first flow path and a second valve to selectively block the second flow path; and at least one priming system associated with each printhead. Each priming system is operable to cause first valve of the associated printhead to open. The at least one priming system may comprise a pressure control mechanism having any of the features of the example pressure control systems 17*a*, 17*b* described above. The first valve and second valves may have any of the features of the first and second valves 56*a*, 56*b* described above in relation to FIG. 5.

In a first block 710 one of the printheads is identified for recirculation of printing fluid. Identifying one of the printheads for recirculation may be performed in any of the manners described above in relation to the operation of the example printing devices 1, 2, 4, 6. Block 710 may be performed by a controller of the printing system. Identifying one of the printheads for recirculation may, in some examples, comprise receiving a user input which identifies one of the printheads for recirculation. In some other examples identifying one of the printheads for recirculation may comprise a controller of the printing system selecting a printhead according to predefined rules. For example, the controller may select a printhead for which most time has elapsed since it was last recirculated to be the identified printhead. In some examples the controller may select a printhead for which a predetermined time period has elapsed since it was last recirculated to be the identified printhead. Such a predetermined time period may be, for example, in range 45 minutes to 75 minutes. In some examples such a predetermined time period may be 60 minutes. In some examples the controller may select a printhead for which a predetermined time period has elapsed since it was last used for a printing operation to be the identified printhead.

In block 720, the first and second valves of each printhead are provided in a closed state. In some examples providing the first and second valves of each printhead in a closed state comprises controlling the fluid pressures in the printing system so as to cause any open valves to become closed. In some examples providing the first and second valves of each printhead in a closed state comprises increasing the fluid pressure in at least one of the printheads. In some examples providing the first and second valves of each printhead in a closed state comprises creating a positive fluid pressure in at least part of the first flow path and in at least part of the second flow path. Providing the first and second valves in a closed state may be performed in any of the manners described above in relation to the operation of the example printing devices 1, 2, 4, 6. Block 720 may be performed by a controller of the printing system.

In block 730, a negative fluid pressure is provided between each first valve and the printing fluid source. The negative fluid pressure may be provided in any of the manners described above in relation to the operation of the example printing devices 1, 2, 4, 6. For example, block 730 may be performed by a controller of the printing system activating a negative fluid pressure source of the printing system. In other examples performing block 730 may comprise providing the printing fluid source and the first valves in a relative arrangement such that the first valves are higher than the printing fluid source with respect to an applied gravitational field.

In block 740 a positive fluid pressure is provided between each second valve and the printing fluid source. The positive fluid pressure may be provided in any of the manners described above in relation to the operation of the example printing devices 1, 2, 4, 6. For example, block 740 may be performed by a controller of the printing system activating a positive fluid pressure source of the printing system. Block 740 may be performed before, after or simultaneously with block 730.

In block 750 the priming system associated with the identified printhead is operated. Operating the priming system may be performed in any of the manners described above for operating the example pressure control mechanisms 17*a*, 17*b*. Performing block 750 causes the opening of the first valve of the identified printhead. Block 750 may be performed by a controller of the printing system. Block 750 may be performed responsive to a predetermined time period having elapsed since the completion of the block 740. The predetermined time period may have any of the features described above in relation to the operation of the example printing devices 1, 2, 4, 6.

In block 760, printing fluid is flowed from the identified printhead to the printing fluid source along the first flow path. The performance of block 760 may occur as a result of the completion of blocks 730 and 750. That is, printing fluid may be caused to flow through the open first valve opened as a result of performing block 750, under the influence of the negative fluid pressure created as a result of performing block 730. The method 700 may therefore be considered to be a method for enabling recirculation of printing fluid in a printhead of a printing system.

Figure 8:
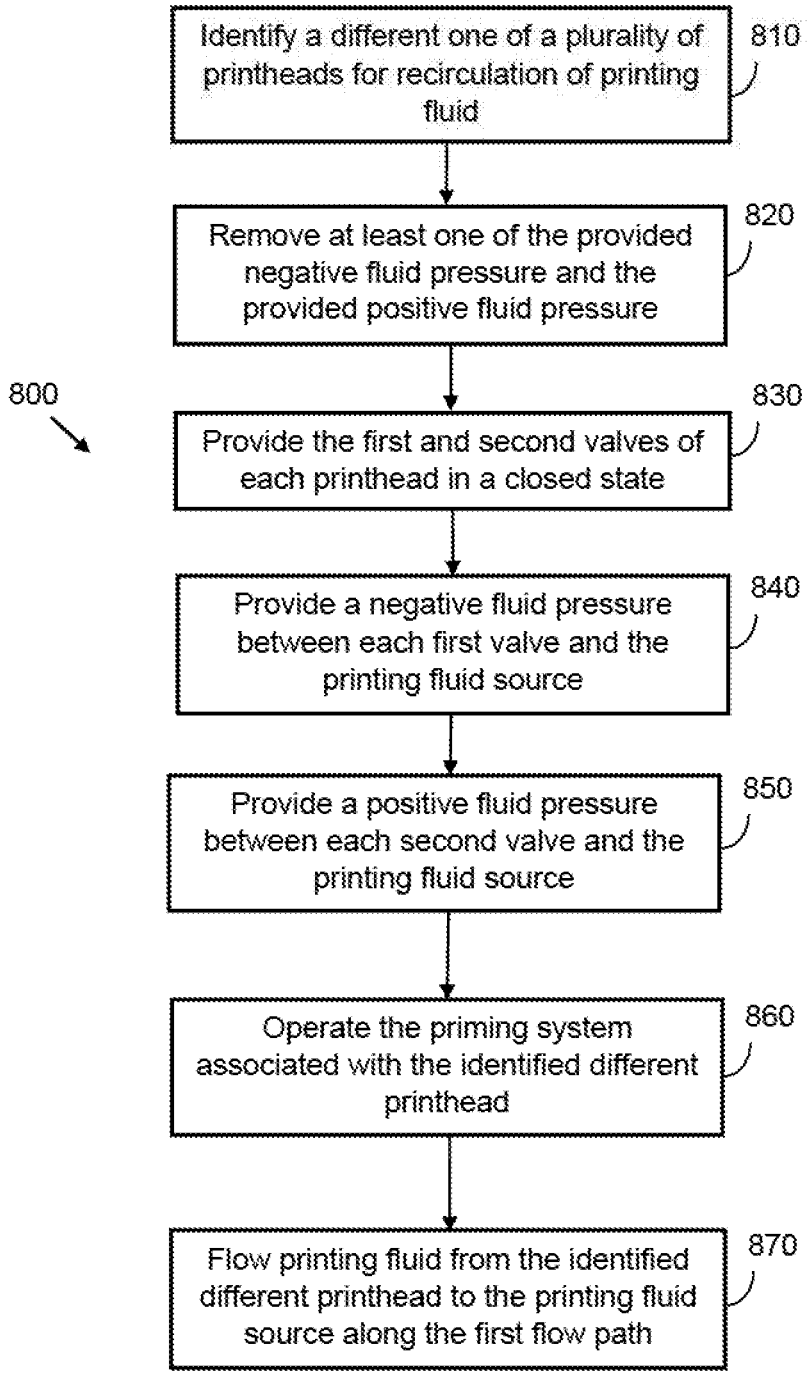
FIG. 8 is a flow diagram showing a further example method of operating a printing system.

A further example method 800 of operating a printing system (which may comprise any of the example printing devices 1, 2, 4, 6 described above) will now be described with reference to FIG. 8, which shows a flow chart implementing the example method 800. The printing system operated by the example method 800 may be the same printing system operated by the example method 700. The method 800 is a method for changing from recirculating one printhead of a plurality of printheads of the printing system to recirculating a different printhead of the plurality of printheads of the printing system.

In block 810 a different one of the printheads is identified for recirculation of printing fluid. The identified different printhead may be identified in the same manner described above in relation to block 710 of the method 700. The identified different printhead may not be a printhead for which recirculation is currently occurring. The identified different printhead may not be a printhead which was most recently recirculated.

In block 820 at least one of the provided negative fluid pressure and the provided positive fluid pressure is removed. Removing at least one of the provided negative fluid pressure and the provided positive fluid pressure may comprise a deactivating a positive fluid pressure source. Removing at least one of the provided negative fluid pressure and the provided positive fluid pressure may comprise a deactivating a negative fluid pressure source. Deactivating a positive or negative fluid pressure source may be performed by a controller of the printing system, in any of the manners described above in relation to the operation of the example printing devices 1, 2, 4, 6, or may be performed manually by a user of the printing system.

In block 830 the first and second valves of each printhead are provided in a closed state. Block 830 may be performed in the same manner as block 720 of the method 700.

In block 840 a negative fluid pressure is provided between each first valve and the printing fluid source. Block 840 may be performed in the same manner as block 730 of the method 700. In block 850 a positive fluid pressure is provided between each second valve and the printing fluid source. Block 850 may be performed in the same manner as block 740 of the method 700. Block 850 may be performed before, after or simultaneously with block 840.

In block 860 the priming system associated with the identified different printhead is operated. Block 860 may be performed in the same manner as block 750 of the method 700, but in respect of the identified different printhead rather than the identified printhead.

In block 870, printing fluid is flowed from the identified different printhead to the printing fluid source along the first flow path. Block 870 may be performed in the same manner as block 760 of the method 700, but in respect of the identified different printhead rather than the identified printhead.

The example method 800 may be implemented by a printing system having any plural number of printheads. It may be repeated in respect of each printhead of the printing system. It may be performed consecutively for each printhead of the printing system. In some examples the printheads may be recirculated according to a predetermined temporal, spatial, or temporal and spatial pattern, which may be stored in a memory accessible by a controller of the printing system.

Figure 9:
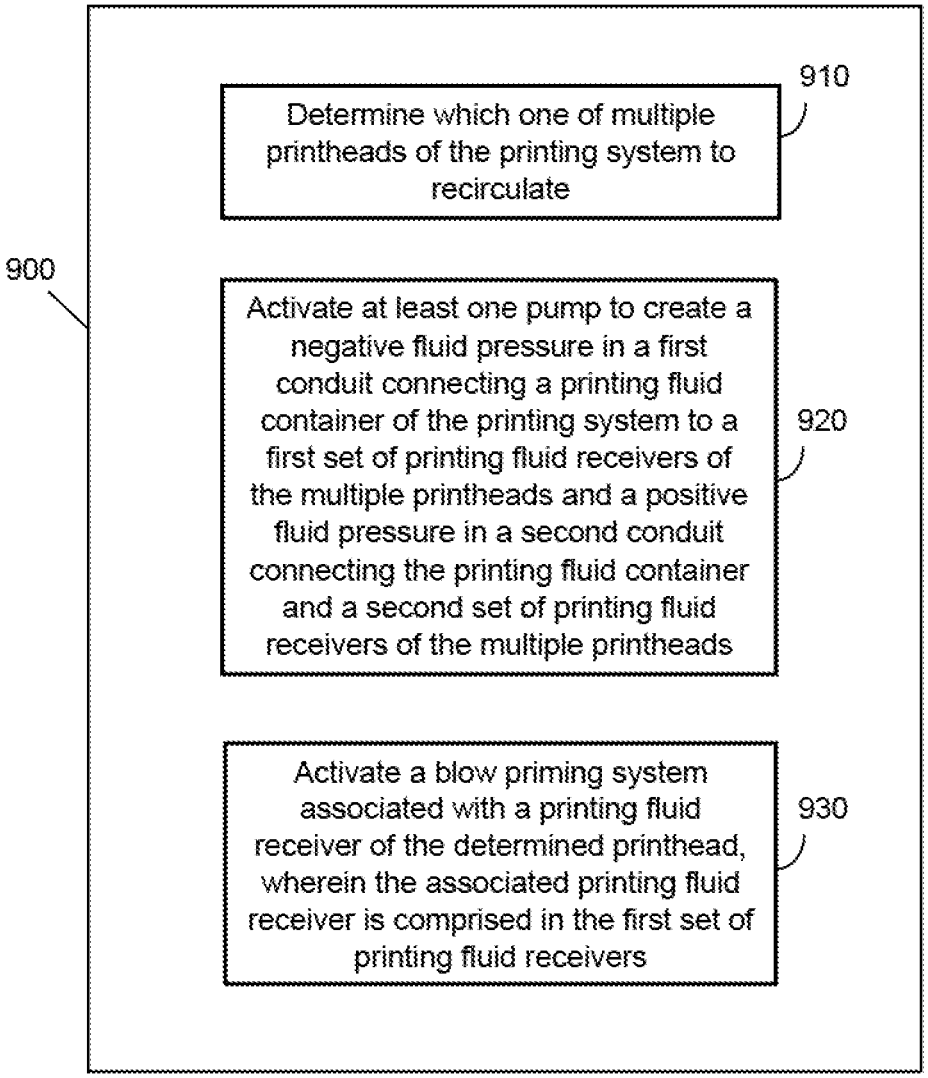
FIG. 9 is a schematic diagram showing an example non-transitory computer-readable storage medium comprising an example set of computer-readable instructions stored thereon.

Some examples provide a non-transitory computer-readable storage medium comprising a set of computer-readable instructions stored thereon. FIG. 9 shows one such example non-transitory computer-readable storage medium 900 comprising a set of computer readable instructions 910-930 stored thereon.

When the computer readable instruction 910 is executed by a processor of a printing system or device, it causes the processor to determine which one of multiple printheads of the printing system or device to recirculate. The determination may be performed in any of the manners described above in relation to the operation of the controller 18. When the computer readable instruction 920 is executed by the processor, it causes the processor to activate at least one pump of the printing system to create a negative fluid pressure in a first conduit connecting a printing fluid container of the printing system to a first set of printing fluid receivers of the multiple printheads and a positive fluid pressure in a second conduit connecting the printing fluid container and a second set of printing fluid receivers of the multiple printheads. Activating the at least one pump may be performed in any of the manners described above in relation to the operation of the controller 18. When the computer readable instruction 930 is executed by the processor, it causes the processor to activate a blow priming system associated with a printing fluid receiver of the determined printhead, wherein the associated printing fluid receiver is comprised in the first set of printing fluid receivers. Activating the blow priming system may be performed in any of the manners described above in relation to the operation of the controller 18.

The printing system may comprise any of the example printing devices 1, 2 and 4 described above. In some such examples, the controller 18 of the example printing device may comprise the processor.

In some examples, the non-transitory computer-readable storage medium may comprise any one of many physical media such as, for example, electronic, magnetic, optical, electromagnetic, or semiconductor media. More specific examples of suitable non-transitory computer-readable storage media include, but are not limited to, a portable magnetic computer diskette such as floppy diskettes or hard: drives, a read-only memory ("ROM"), an erasable programmable read-only memory, a portable compact disc or other storage devices that may be coupled to the processor directly or indirectly. Alternatively, the non-transitory computer-readable storage medium may be a random access memory ("RAM") device. The non-transitory computer-readable storage medium may comprise any combination of one or more of the foregoing and/or other devices as well. In some examples, the processor may comprise a microprocessor.

Certain examples described herein provide a system or method to help avoid the settling or agglomeration of pigment or particles of printing fluid in a printing device having multiple printheads connected in parallel to a supply of printing fluid.

The preceding description has been presented to illustrate and describe examples of the principles described. This description is not intended to be exhaustive or to limit these principles to any precise form disclosed. Many modifications and variations are possible in light of the above teaching.

What is claimed is:

1. A printing device comprising:

a printing fluid supply;

a plurality of printheads connected in parallel to the printing fluid supply by a first flow path and a second flow path; each of the printheads comprising a closable first opening connected to the first flow path and a closable second opening connected to the second flow path, and each of the printheads having an associated pressure control mechanism operable to increase a fluid pressure in the printhead, wherein the first opening of each printhead is to open in response to the operation of the pressure control mechanism associated with the printhead;

a first fluid pressure source to create a negative fluid pressure between the printing fluid supply and the first openings;

a second fluid pressure source to create a positive fluid pressure between the printing fluid supply and the second openings; and a controller to identify a first printhead of the printheads for which printing fluid in the first printhead is to be recirculated to the printing fluid supply; and operate the pressure control mechanism associated with the identified printhead to open the first opening of the identified printhead.

2. The printing device of claim 1, wherein the first fluid pressure source or the second fluid pressure source is a selectively activatable fluid pressure source and the controller is to activate the selectively activatable fluid pressure source.

3. The printing device of claim 2, wherein the controller is to activate the selectively activatable fluid pressure source at a first time, and to operate the selected pressure control mechanism at a second time, wherein the second time is later than the first time by a delay value.

4. The printing device of claim 2, wherein the controller is to change the printhead being recirculated from the identified first printhead to a different printhead by:

identifying a third of the printheads for which printing fluid in the printhead is to be recirculated to the printing fluid supply;

deactivating the selectively activatable fluid pressure source; and operating the pressure control mechanism associated with the identified third printhead to open the first opening of the identified third printhead.

5. The printing device of claim 1, wherein the second fluid pressure source is selectively connectable to the first openings, to create a positive fluid pressure between the printing fluid supply and the first openings and between the printing fluid supply and the second openings.

6. The printing device of claim 5, wherein the controller is to change the printhead being recirculated from the identified printhead to a different printhead by:

identifying a second printhead of the printheads for which printing fluid in the printhead is to be recirculated to the printing fluid supply;

operating a valve to create a flow path between the second fluid pressure source and the first openings for a predefined time period;

operating the valve to block the flow path between the second fluid pressure source and the first openings after the predefined time period has elapsed; and operating the pressure control mechanism associated with the identified second printhead to open the first opening of the identified second printhead.

7. The printing device of claim 1 wherein the first fluid pressure source is a gravitational fluid pressure source, such that the negative fluid pressure between the printing fluid supply and the first openings is created as a result of the first openings being higher than the printing fluid supply in an in-use orientation of the printing device.

8. The printing device of claim 1, wherein each printhead comprises:

a first chamber; and a second chamber in fluid communication with the first chamber;

wherein the first opening of each printhead opens into the first chamber and the second opening of each printhead opens into the second chamber; and, wherein each of the first opening and the second opening comprises a needle.

9. The printing device of claim 1, comprising an air-tight container for containing printing fluid in fluid communication with the second flow path; wherein the second fluid pressure system comprises an air pressure system to supply pressurized air into the container.

10. The printing device of claim 1, wherein each pressure control mechanism comprises:

an expandable component within a chamber for containing printing fluid of the associated printhead; and a selectively activatable mechanism to cause expansion of the expandable component.

11. The printing device of claim 10, wherein the expandable component comprises a regulator bag, and the selectively activatable mechanism comprises a blow priming pump connectable to the regulator bag to inflate the regulator bag.

12. The printing device of claim 10, wherein the first opening of the associated printhead comprises a valve connected to the expandable component such that expansion of the expandable component causes the valve to open.

13. The printing device of claim 1, wherein printing fluid flows between the first openings and the printing fluid supply, and printing fluid flows between the printing fluid supply and the second openings.

14. The printing device of claim 1, wherein print fluid flows between the printing fluid supply and the first openings, and printing fluid flows between the second openings and the printing fluid supply.

15. A method of operating a printing system, the printing system comprising a printing fluid source; a plurality of printheads each connected to the printing fluid source by a first flow path and a second flow path and each comprising a first valve to selectively block the first flow path and a second valve to selectively block the second flow path; and a priming system associated with each printhead, wherein each priming system is operable to cause first valve of the associated printhead to open; the method comprising:

identifying a first printhead of the printheads for recirculation of printing fluid;

providing the first and second valves of each printhead in a closed state;

providing a negative fluid pressure between each first valve and the printing fluid source;

providing a positive fluid pressure between each second valve and the printing fluid source;

operating the priming system associated with the identified printhead;

flowing printing fluid from the identified first printhead to the printing fluid source along the first flow path.

16. The method of claim 15, comprising:

identifying a second printhead of the printheads for recirculation of printing fluid;

removing a provided negative fluid pressure and the provided positive fluid pressure;

providing the first and second valves of each printhead in a closed state;

providing a negative fluid pressure between each first valve and the printing fluid source;

providing a positive fluid pressure between each second valve and the printing fluid source;

operating the priming system associated with the identified second printhead;

flowing printing fluid from the identified second printhead to the printing fluid source along the first flow path.

17. The method of claim 15, further comprising flowing printing fluid from the printing fluid source to the identified first printhead along the second flow path.

18. The method of claim 17, further comprising subsequently flowing printing fluid from the printing fluid source to the identified first printhead along the first flow path, and flowing printing fluid from the identified first printhead to the printing fluid source along the second flow path.

19. A non-transitory computer-readable storage medium comprising a set of computer-readable instructions stored thereon, which, when executed by a processor of a printing system, cause the processor to:

determine a number of multiple printheads of the printing system to recirculate;

activate a first pump to create a negative fluid pressure in a first conduit connecting a printing fluid container of the printing system to a first set of printing fluid receivers of the multiple printheads and a positive fluid pressure in a second conduit connecting the printing fluid container and a second set of printing fluid receivers of the multiple printheads; and activate a blow priming system associated with a printing fluid receiver of the determined printhead, wherein the associated printing fluid receiver is comprised in the first set of printing fluid receivers.

20. The non-transitory computer-readable storage medium of claim 19 further comprising a set of computer-readable instructions stored thereon, which, when executed by a processor of a printing system, cause the processor to recirculate printing fluid from the first conduit to a printing fluid supply.

* * * * *